US006595688B2

(12) United States Patent
Schneck

(10) Patent No.: US 6,595,688 B2
(45) **Date of Patent: *Jul. 22, 2003**

(54) SEALABLE VALVE BAG AND METHOD FOR MAKING A SEALABLE VALVE BAG

(75) Inventor: Gene D. Schneck, Ridgeland, MS (US)

(73) Assignee: Hood Packaging Corporation, Madison, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/928,895

(22) Filed: Aug. 13, 2001

(65) Prior Publication Data

US 2002/0164092 A1 Nov. 7, 2002

Related U.S. Application Data

(63) Continuation-in-part of application No. 09/847,672, filed on May 2, 2001, now Pat. No. 6,499,879.

(51) Int. Cl.[7] ..... B65D 30/24

(52) U.S. Cl. ..... 383/54; 383/44; 383/46

(58) Field of Search ..... 383/54, 44, 46, 383/48, 52

(56) References Cited

U.S. PATENT DOCUMENTS

| | | | |
|---|---|---|---|
| 2,147,970 A | 2/1939 | Du Bois | |
| 3,130,897 A | 4/1964 | Poklukar et al. | |
| 3,191,850 A | 6/1965 | Niemeyer | |
| 3,261,267 A | 7/1966 | Becker | |
| 4,049,191 A | 9/1977 | Stearley | |
| 4,166,482 A | 9/1979 | Sanders | |
| 4,367,620 A | 1/1983 | Fox | |
| 4,391,404 A | 7/1983 | Welter | |
| 4,453,270 A | 6/1984 | Donini et al. | |
| 4,759,640 A | 7/1988 | Gröner | |
| 5,516,210 A | 5/1996 | Kelley et al. | |
| 5,806,982 A | 9/1998 | Kelley et al. | |
| 6,164,823 A | 12/2000 | Donnell | |

FOREIGN PATENT DOCUMENTS

| | | |
|---|---|---|
| AU | 466110 | 4/1973 |
| DE | 2 218 867 | 10/1973 |
| DE | 25 19 494 | 11/1976 |
| DE | 3203187 A | 8/1983 |
| EP | 498 047 A1 | 8/1992 |
| FR | 2 228 004 | 11/1974 |
| FR | 2 303 727 | 10/1976 |
| WO | WO 92/06014 | 4/1992 |

*Primary Examiner*—Jes F. Pascua
(74) *Attorney, Agent, or Firm*—Marshall, Gerstein & Borun

(57) ABSTRACT

The valve bag includes a bag body having a valve end portion, the valve end portion constructed to form a filling passage in which a valve sleeve is inserted. The valve sleeve has a first end extending into the interior of the valve bag and a second end extending exteriorily from the bag body. A valve protection member is secured to the second end.

14 Claims, 3 Drawing Sheets

FIG 8
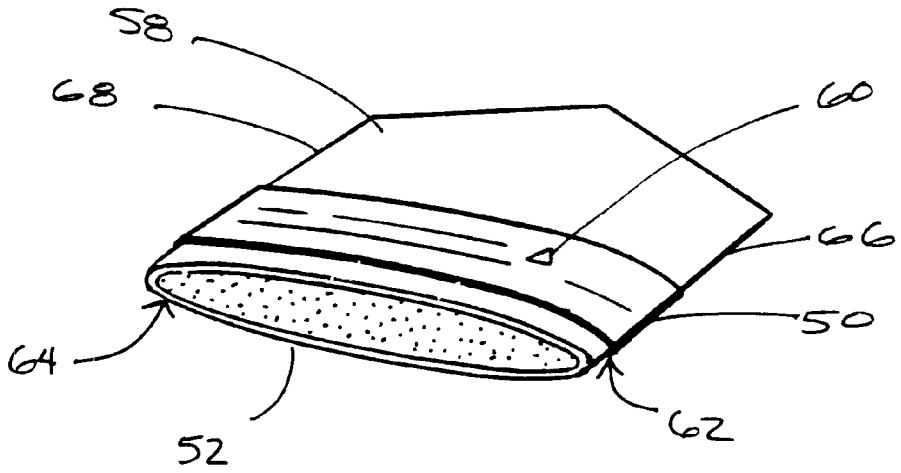
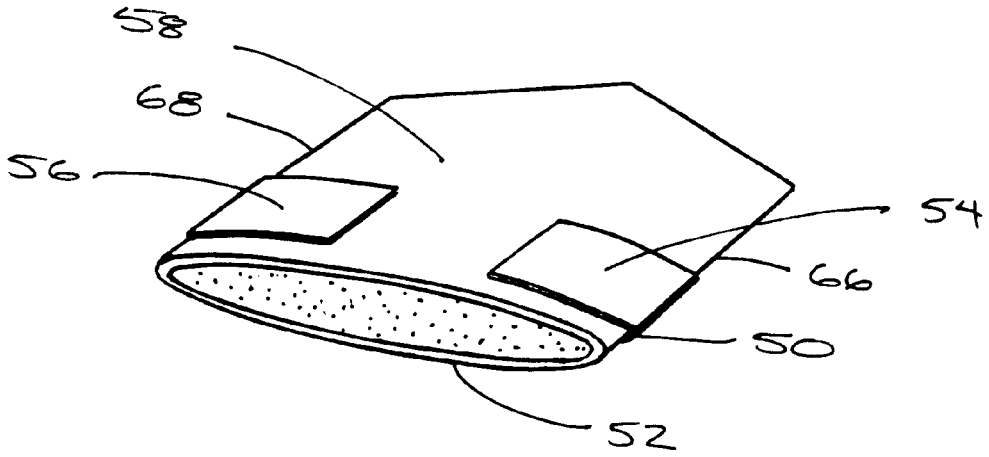
FIG. 7

SEALABLE VALVE BAG AND METHOD FOR MAKING A SEALABLE VALVE BAG

CROSS-REFERENCE TO RELATED APPLICATION

The present application is a continuation-in-part of the U.S. patent application Ser. No. 09/847,672, filed May 2, 2001, now U. S. Pat. No. 6,499,879.

FIELD OF THE INVENTION

The invention relates generally to sealable valve bags and, more specifically to the valve sleeve used to fill and seal the valve bags. These shipping sacks are commonly used to contain and transport granular products, examples of which are fertilizers, animal feeds or grain.

BACKGROUND OF THE INVENTION

Flexible bags such as paper shipping sacks may include a sealable valve sleeve placed in a filling valve, the filling valve is located in a corner of the flexible bag to allow introduction of material that is to be held within the bag. These shipping sacks are commonly used to contain and transport material such as granular products, examples of which are fertilizers, animal feeds or grain. The sealable sleeve provides a convenient means to fill and securely close the flexible bag to prevent the contents of the bag from leaking or sifting out of the bag once the bag has been filled. Sleeves may be constructed of a variety of materials such as paper, polyethylene tubing or a thermoplastic liner.

A typical sleeve for a paper shipping sack, such as a pasted valve type multiwall shipping sack, is made from a rectangular sheet of kraft paper that is rolled into a cylindrical shape and secured in the cylindrical shape by overlapping or abutting the opposing edges of the sheet of paper to one another and gluing to form a seam. Such a sleeve is described in commonly assigned U.S. Pat. No. 6,164,823, the disclosure of which is hereby expressly incorporated by reference. In order to seal the valve sleeve and therefore the valve passage after the shipping sack is full, heat, typically generated by ultrasonic vibrations, is applied to the exterior surface of the valve sleeve melting the thermoplastic film liner sealing the sleeve and securing the contents within the shipping sack.

However, due to the interaction between the vibrating jaw of the ultrasonic generator and the outer surface of the valve sleeve, the valve sleeve is often damaged. The damage to the valve sleeve may make it possible for the contents of the bag to leak or sift out of the bag even after the sealing operation has been completed.

Valve sleeves have been constructed of multiple sheets of paper to strengthen the valve sleeve and facilitate filling of the flexible bag. This design has a high non-conforming rate, often as great as fifteen percent, because the difficulties of aligning the several sheets of paper to the valve sleeve results in discontinuities around the valve sleeve and allow product to escape from the bag.

BRIEF DESCRIPTION OF THE DRAWINGS

FIG. 7 is a perspective view of the valve sleeve, showing the protective member extending over the valve sleeve.

FIG. 8 is a view similar to FIG. 7, showing the protective member adapted to engage a two surface of the valve sleeve simultaneously

DETAILED DESCRIPTION OF THE PREFERRED EMBODIMENT

Figure 1:
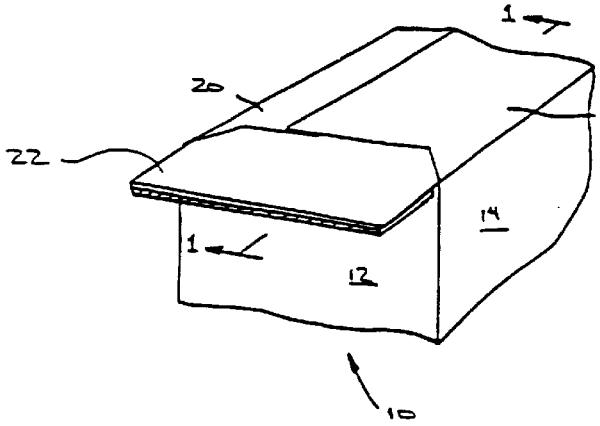
FIG. 1 is a perspective view of the valve bag, having a valve sleeve constructed in accordance with the invention, with the valve sleeve in the closed position.
Figure 2:
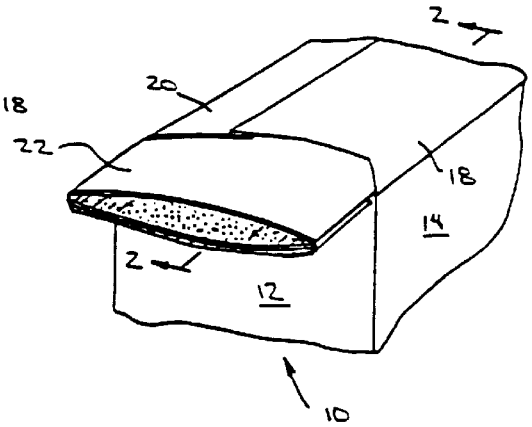
FIG. 2 is a perspective view of the valve bag of FIG. 1, with the valve sleeve in the open position.
Figure 3:
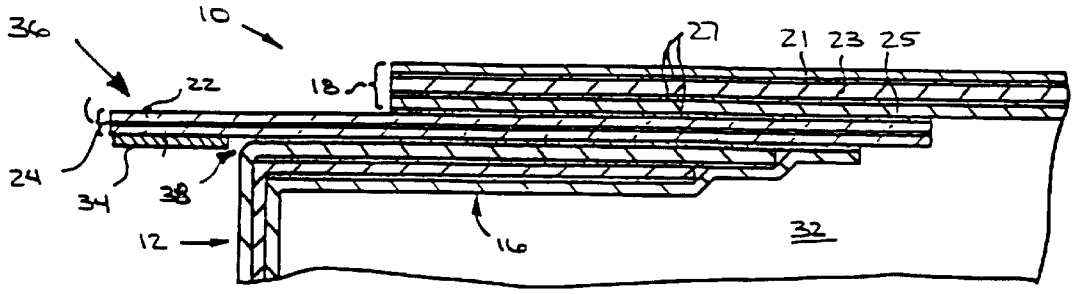
FIG. 3 is a cross-sectional view of the valve sleeve of FIG. 1, taken along line 1—1 of FIG. 1.
Figure 4:
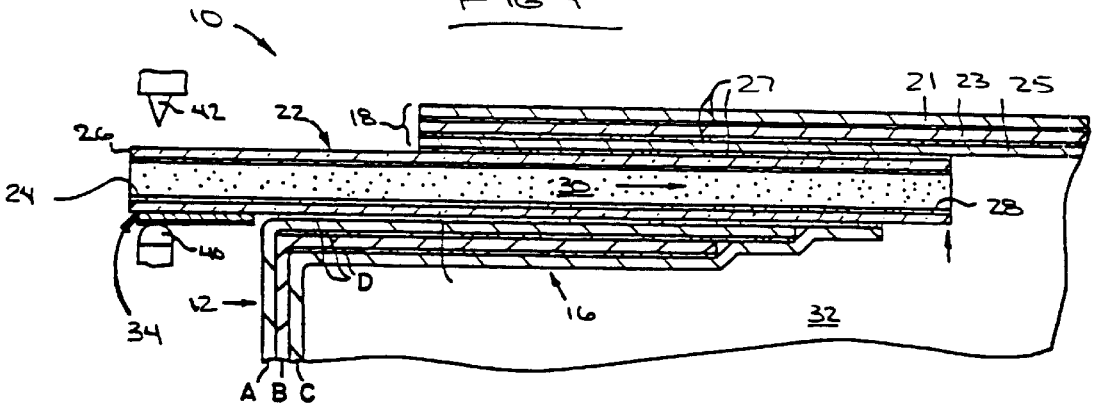
FIG. 4 is a cross-sectional view of the valve sleeve of FIG. 2, taken along the line 2—2 of FIG. 2 and showing the ultrasonic generator in contact with the protection member.

A valve sleeve for a flexible bag constructed in accordance with the present invention includes a cylindrical tube including a heat sealable liner and protective member secured to the cylindrical tube. The protective member is arranged to cover a portion of one end of the valve sleeve extending from the valve passage protecting the valve during the sealing process.

A flexible bag having a valve sleeve constructed to include a valve sleeve in accordance with the invention will be resistant to the damage caused during sealing of the valve sleeve and prevent contents of the flexible bag from escaping due to the damage.

Further, a flexible bag having a valve sleeve constructed to include a protective member in accordance with the invention will be easier to manufacture and result in less scrap and non-conforming valve bags. The protective member of the present invention is external to the valve passage to prevent the possibility of discontinuities, and is smaller than the valve sleeve itself to facilitate alignment, both of these improvements make the flexible bag easier to manufacture and decrease the non-conforming rate.

Additional benefits and features of the invention will be apparent to those skilled in the art from a review of the following detailed description taken in conjunction with the drawings and applied claims.

The following description of the disclosed embodiment is not intended to limit the scope of the invention to the precise form or forms detailed herein. Instead, the following description is intended to be illustrative of the principles of the invention so that others may follow its teachings.

Referring now to the drawings, a valve bag capable of being sealed is shown in FIGS. 1–4. A valve bag 10 includes side walls 12, 14, in-folded flap 16, and outer flaps 18, 20. The valve bag 10 is preferably a valve bag having multiple walls 21, 23, 25 adhered together, at least in portion, by layers of adhesive 27.

The valve bag 10, in order to facilitate filling and subsequent sealing also includes a valve sleeve 22. The valve sleeve 22 is cylindrical tube that has a uniform length from its outside end 26, to its inside end 28. The valve sleeve 22 may be formed from a single, rectangular sheet of relatively stiff kraft paper having a thermoplastic film 24 that coats the entire interior of the valve sleeve 22, and such as disclosed and described in the aforementioned U.S. Pat. No. 6,164,823. A valve sleeve protection member 34 is affixed to the exterior of the valve sleeve 22, substantially adjacent to the outside end 26, and extending towards its inside end 28, substantially adjacent with side wall 12. The entire valve sleeve assembly 36, valve sleeve 22 and protection member 34 is affixed in the filling passage 38 created between the in-folded flap 16 and outer flaps 18, 20 and secured by adhesive 27.

The filling of the valve bag 10, is accomplished by inserting a fill nozzle (not shown) into the valve sleeve passage 30 defined by the valve sleeve 22 and discharging material into the interior 32 of valve bag 10. Upon completion of filling, the valve sleeve 22 is typically sealed by positioning the outside end 26 between a head 40 and an anvil 42 of an ultrasonic generator. The protection member 34 is thus positioned between the head 40 and the valve sleeve 22. Ultrasonic energy generated by the vibration of the head 40 activates the thermoplastic film 24 to seal the valve sleeve 22. The protection member 34 protects the kraft paper surface of the valve sleeve 22 from damage created by the motion of the head 40. Accordingly, a tight seal is achieved and damage, such as holes or imperfections, that would allow filling material to escape the valve bag 10 after sealing was complete is reduced.

Figure 5:
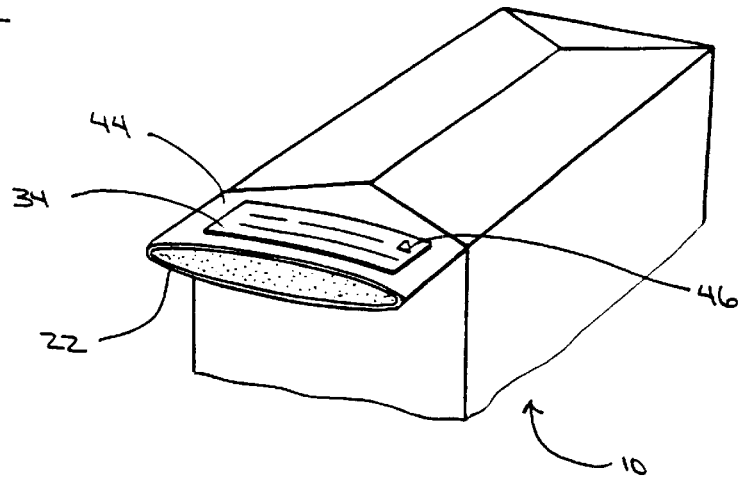
FIG. 5 is a view similar to FIG. 2, showing text or graphics on the protective member.

In another embodiment shown in FIG. 5, the valve bag 10 includes a valve sleeve protection member 34 attached to a surface 44 of the valve sleeve 22. The valve sleeve protection member 34 has been adapted to display text or graphics 46.

Figure 6:
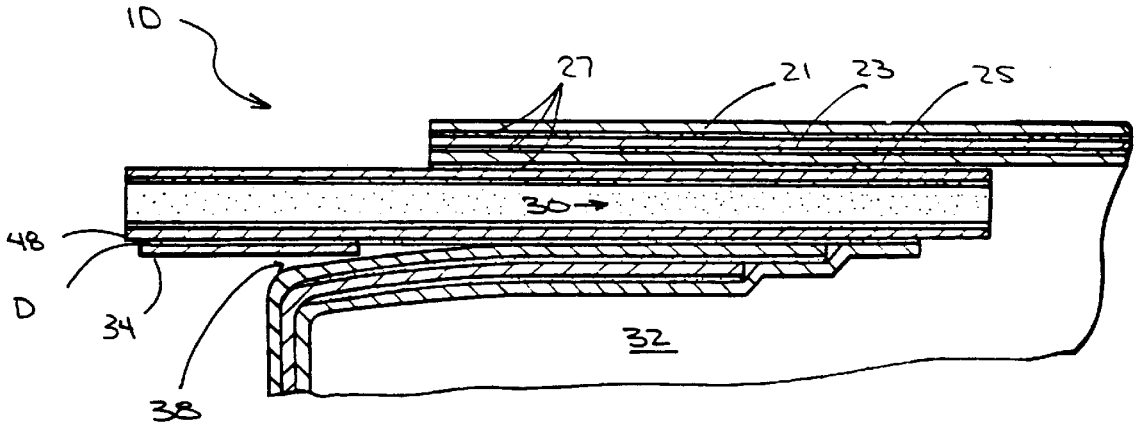
FIG. 6 is a view similar to FIG. 4, showing the protective member extending into the valve passage.

In another embodiment shown in FIG. 6, the protective member 34 is shown to extend into the valve bag filling passage 38. The protective member 34 is attached to the lower surface 48 with adhesive 27. The protective member 34 extends inward towards the interior 32 of the valve bag 10 but is not attached to any of the multiple walls 21, 23, or 25.

In another embodiment shown in FIG. 7, the protection member 50 is primarily attached to the lower surface 52 and has a first end 54 and a second end 56 adapted to engage a second surface 58 of the valve sleeve 22. Further, the embodiment of the protection member 50, illustrated in FIG. 8, has been adapted to display text or graphics 60 while engaging the lower surface 52 with a first end 62 and a second end 64, in manner similar to the embodiment illustrated in FIG. 7. By attaching the protection member 50 to the lower surface 52 and engaging the second surface 58 the edges 66, 68 of the valve sleeve 22 are protected from damage during the sealing process.

Those skilled in the art will appreciate that, although the teachings of the invention have been illustrated in connection with a certain embodiment, there is no intent to limit the invention to said embodiment. On the contrary, the intention of this application is to cover all modifications and embodiments fairly falling within the scope of the appended claims either literally or under the doctrine of equivalents.

What is claimed:

1. A valve bag apparatus for the containment of material, comprising:

a bag body portion having a valve end portion;

a filling passage formed in the bag body at the valve end portion;

a sealable valve sleeve secured within the filling passage, the sealable valve sleeve having a first end extending into the interior of the bag body and a second end extending exteriorily from the bag body; and a protection member secured adjacent to the second end and distal to the bag body portion such that the protection member is completely external to the filling passage.

2. The valve bag of claim 1, wherein the protection member extends inward to a position substantially adjacent to the exterior of the bag body.

3. The valve bag of claim 1, wherein the protection member comprises a piece of paper.

4. The valve bag of claim 1, wherein the protection member comprises a self-adhesive label.

5. The valve bag of claim 4, wherein the protection member contains text or graphics.

6. The valve sleeve of claim 1, wherein the protection member is disposed adjacent to a head side of the ultrasonic generator.

7. The valve sleeve of claim 1, wherein the protection member extends into the filling passage.

8. The valve bag of claim 1, wherein the valve sleeve has a first surface and a second surface and the protection member engages both surfaces.

9. A valve bag apparatus for the containment of material, comprising:

a bag body portion having a valve end portion;

at least one in-folded flap member and at least one out-folded flap member disposed in the valve end portion to form a filling passage;

a sheet secured to the filling passage having a first end extending inwardly to a position within the bag body and a second end extending exteriorily from the bag body, the sheet having a first edge and a second edge disposed substantially adjacent to each other to define an interior surface and an exterior surface;

a heat sealable material coating the interior surface; and a protection member secured adjacent to the second end and distal to the bag body portion such that the protection member is completely external to the filling passage.

10. A method of constructing a valve bag, the method comprising the steps of:

providing a bag body portion having a valve end portion;

constructing a filling passage in the bag body at the valve end portion;

securing a valve sleeve within the filling passage, the valve sleeve having a first end extending into the bag body and a second end extending exteriorily from the bag body; and securing a protection member adjacent to the second end and distal to the bag body portion such that the protection member is completely external to the filling passage.

11. A valve bag apparatus for the containment of material, comprising:

a bag body portion having a valve end portion;

a filling passage formed in the bag body at the valve end portion;

a sealable valve sleeve secured within the filling passage, the sealable valve sleeve having an interior end extending into the bag body and a exterior end extending outward from the bag body; and a protection member secured adjacent to the exterior end and engaging a first surface and a second surface of the protection member, the protection member positioned distal to the bag body portion such that the protection member is completely external to the filling passage.

12. The valve bag of claim 11, wherein the protection member comprises a piece of paper.

13. The valve bag of claim 11, wherein the protection member comprises a self-adhesive label.

14. The valve bag of claim 11, wherein the protection member contains text or graphics.

* * * * *